United States Patent [19]

Walker

[11] 3,963,080

[45] June 15, 1976

[54] TUNNELING MACHINE FOR BORING A SIDE DRIFT

[75] Inventor: Ross W. Walker, Beaumont, Tex.

[73] Assignee: Dresser Industries, Inc., Dallas, Tex.

[22] Filed: Jan. 29, 1975

[21] Appl. No.: 545,286

[52] U.S. Cl. ..... 175/94; 175/61; 299/31

[51] Int. Cl.[2] ..... E21D 9/10

[58] Field of Search ..... 299/31, 33, 56; 175/94, 175/97, 61, 62

[56] References Cited

UNITED STATES PATENTS

| | | | |
|---|---|---|---|
| 2,919,121 | 12/1959 | Ruth | 175/94 X |
| 2,946,578 | 7/1960 | De Smacle | 175/62 X |
| 3,345,108 | 10/1967 | Newman et al. | 299/31 |
| 3,415,574 | 12/1968 | Lauber | 299/31 |
| 3,511,539 | 5/1970 | Schonfeld | 299/31 X |
| 3,640,573 | 2/1972 | Safar | 299/31 |
| 3,695,717 | 10/1972 | Birrer | 299/31 |
| 3,840,271 | 10/1974 | Sugden | 299/31 |

FOREIGN PATENTS OR APPLICATIONS

| | | | |
|---|---|---|---|
| 278,076 | 5/1969 | Austria | 299/31 |

*Primary Examiner*—Ernest R. Purser
*Assistant Examiner*—William F. Pate, III
*Attorney, Agent, or Firm*—Eddie E. Scott

[57] ABSTRACT

A tunneling machine is disclosed for boring a side drift extending from a main tunnel. The earth boring machine includes a main beam assembly for longitudinal disposition within said tunnel. A cutterhead support assembly is connected to said main beam. A cutterhead assembly including a cutterhead is mounted on said cutterhead support assembly for rotation generally about the longitudinal axis of said tunneling machine. Power means are coupled to said cutterhead assembly for rotation of the cutterhead. A first vertical gripper assembly is slidably connected to said main beam assembly and engageable with the back and the invert of said tunnel for facilitating the advance and guidance of said main beam, cutterhead support, cutterhead assembly, and cutterhead. Guiding thrust means are provided between said first vertical gripper assembly and said main beam assembly for providing a horizontal guiding force to said main beam assembly. A second vertical gripper assembly is slidably connected to said main beam assembly and engageable with the back and invert of said tunnel for facilitating the advance of said main beam, cutterhead support, cutterhead assembly, and cutterhead longitudinally through said tunnel. Thrust ram means are provided between said second vertical gripper assembly and said cutterhead support assembly for forcing said cutterhead against the working face.

6 Claims, 6 Drawing Figures

TUNNELING MACHINE FOR BORING A SIDE DRIFT

BACKGROUND OF THE INVENTION

The present invention relates to earth boring and, more particularly, to an earth boring machine for operating under conditions wherein one or both of the side walls are absent.

Until recently, tunneling has been accomplished mechanically using dynamite and various hand-operated tools. Recently tunnel boring machines have been developed having many advantages over conventional tunneling systems. For example, the new tunneling machines provide increased safety during the tunneling operation and faster muck removal. The tunnel boring machines eliminate the use of explosives, and the walls and back of the tunnel formed by the tunneling machine remain virtually undisturbed, requiring little or no support. Conventional tunneling machines, however, have encountered certain difficulties when attempting to bore a side drift off of the main tunnel or under other conditions wherein a normal side wall is missing.

If the tunnel does not have a full side wall on both sides of the machine, the cutterhead assembly will have a tendency to shift from the desired tunnel direction. The absence of firm ground normally used to guide the cutterhead assembly and to provide reaction for the side steering cylinders makes guidance of the tunneling machine impossible. An example of a tunnel without a full side wall is when a tunnel being bored intersects an existing tunnel, losing its side wall at the intersection. Another example is when a branch drift is bored from a main drift and the machine is subsequently backed out of the branch drift to further advance the heading of the original main drift.

DESCRIPTION OF PRIOR ART

In U.S. Pat. No. 3,598,445 to Douglas F. Winberg, patented Aug. 10, 1971, a tunnel-boring machine is disclosed which can be used for boring circular tunnels through rock. The machine comprises a rotary cutterhead, a cutterhead support, a main beam, and a gripper. On the front of the cutterhead there are mounted cutters which fracture the rock. The cutterhead support provides journal mounting for the cutterhead, and is centrally connected to the forward end of the main beam by ball and socket joint means. The ball and socket joint permits angular movement in all directions, via., X-Y-Z axis, between the cutterhead support and the main beam. The main beam extends rearwardly and is connected by slide way means to the gripper, which permits the main beam to move in a longitudinal direction. The gripper, which is a force reaction member of the machine, bridges across the tunnel, providing a rear pivoting support means about the X and Y axis for the main beam, and rigidly fixes the location of the pivot axis at the approximate center of the tunnel.

In U.S. Pat. No. 3,776,595 to Douglas F. Winberg, patented Dec. 4, 1973, a machine for boring a tunnel in a subterranean formation is disclosed comprising a main beam; a cutterhead support assembly attached to the main beam; a cutterhead assembly mounted for rotation on the cutterhead support assembly; and a means connected to the main beam for advancing the cutterhead and cutterhead support assemblies to cut a tunnel through the formation. The cutterhead support assembly may include a blade assembly projecting radially towards the walls of the tunnel for cleaning the invert of the tunnel as the cutterhead support assembly advances therethrough. The cutterhead support assembly may be provided with a passageway communicating with a passageway beneath the main beam to form a continuous human passageway along the invert of the tunnel, throughout the length of the tunneling machine, through which the face of the cutterhead assembly may be reached. The blade assembly may be mounted on the cutterhead support assembly for movement between first and second positions, blocking and unblocking the human passageway, respectively.

SUMMARY OF THE INVENTION

The present invention provides an earth boring machine that will allow the advance of a tunnel face under conditions wherein the tunnel, for any reason, does not have one or both full side walls. The machine includes a main beam means and cutterhead means for disintegrating the formations connected to said main beam means. Power means are coupled to the cutterhead means for providing power to said cutterhead means to rotate the cutterhead and disintegrate the earth formations. Thrust means force the cutterhead into contact with the tunnel face. A first gripper means in sliding contact with said main beam means provides engagement with the invert and back of the tunnel. Second gripper means in sliding contact with the main beam provides engagement with the invert and back of the tunnel. Although the present invention is described with reference to a tunnel, it will be appreciated that an earth boring machine constructed in accordance with the present invention has utility in other excavations wherein one or both side walls are absent. The foregoing and other features and advantages of the present invention will become apparent from a consideration of the following detailed description of the invention when taken in conjunction with the drawings.

DETAILED DESCRIPTION OF THE INVENTION

Figure 1:
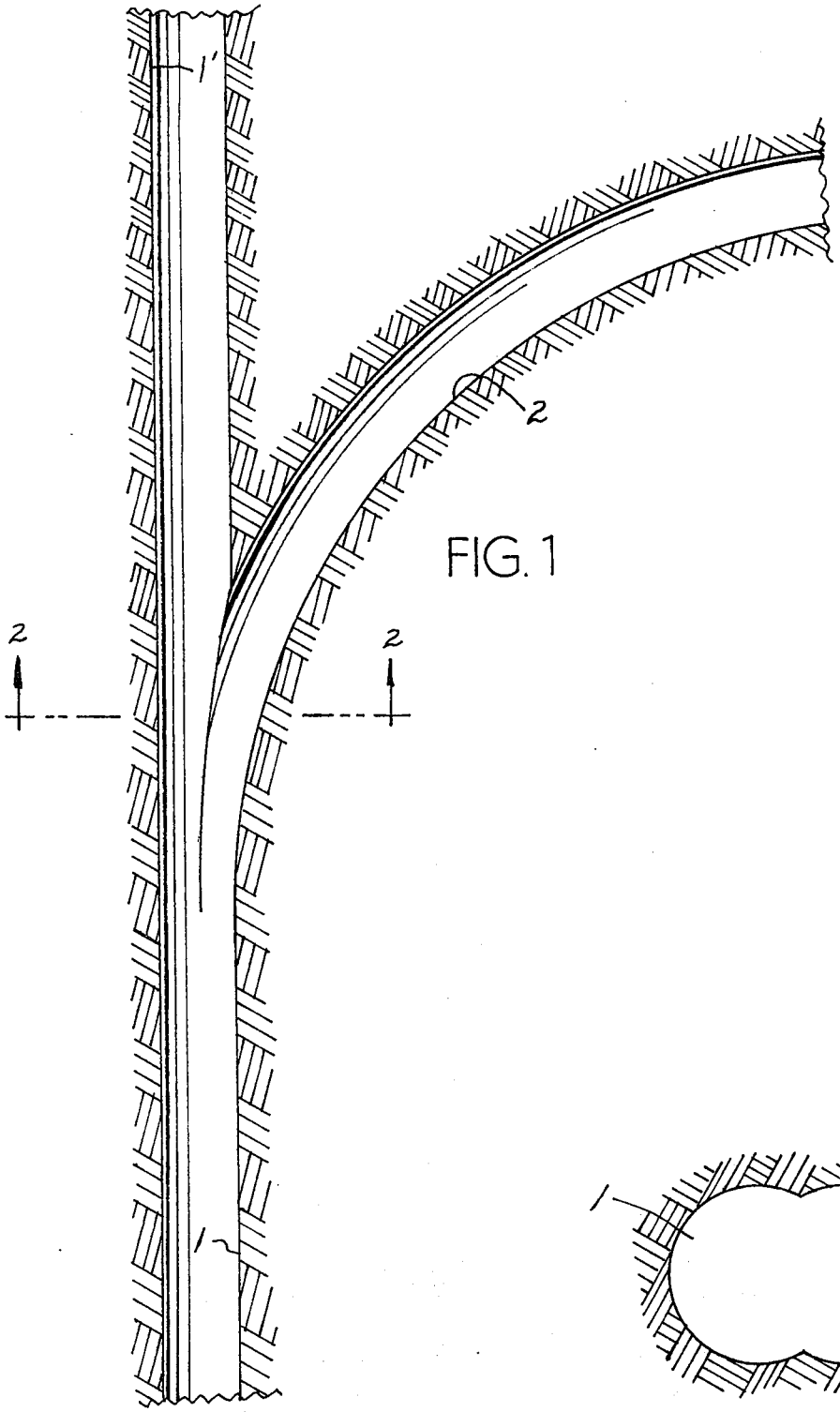
FIG. 1 shows a plan view of a main tunnel and a side drift extending away from the main tunnel.

Referring now to the drawings, and in particular to FIG. 1, a plan view of a main tunnel 1 is shown with a branch drift 2 extending angularly away from the main tunnel 1. An extension 1' of main tunnel 1 continues beyond the point where side drift 2 branches away from the main tunnel 1. When a tunnel boring machine is boring the tunnel 1 and the side drift 2, the boring operation may be accomplished in one of two ways. The tunneling machine may, on a first pass, bore the side drift 2 along a curve turning at an angle to the main tunnel 1. The tunneling machine is then backed into the main tunnel 1 and boring of the extension 1' of the main tunnel 1 is accomplished as an extension of the longitudinal axis of the main tunnel 1. Alternatively, the main tunnel 1 and extension 1' may be bored and the tunneling machine backed into main tunnel 1. The tunneling machine then may be used to bore the side drift 2 extending angularly from the main tunnel 1. In either operation, a length of tunnel must be bored under conditions wherein at least one of the normal full side walls is absent.

Figure 2:
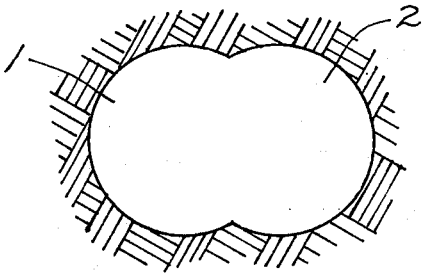
FIG. 2 is a section of the main tunnel and side drift taken along lines 2—2 of FIG. 1.

Referring now to FIG. 2, a section of the main tunnel 1 and side drift 2 is shown taken along lines 2—2 of FIG. 1. Considering the tunnel boring operations discussed above, the tunnel boring machine must operate for a period of time without the benefit of a full side wall. If the side drift 2 is being bored on a first pass and the machine is backed into the main tunnel 1 for the boring of the extension 1' of the main tunnel 1, the earth boring machine will have to operate for a period of time wherein the right side wall of main tunnel 1 as shown in FIG. 2 is absent. If the tunnel boring operation proceeds by the boring of the main tunnel 1 and the extension 1' with the boring machine backed into the main tunnel 1 prior to the boring of side drift 2, the boring machine must operate for a period of time wherein the left side wall is absent.

Figure 3:
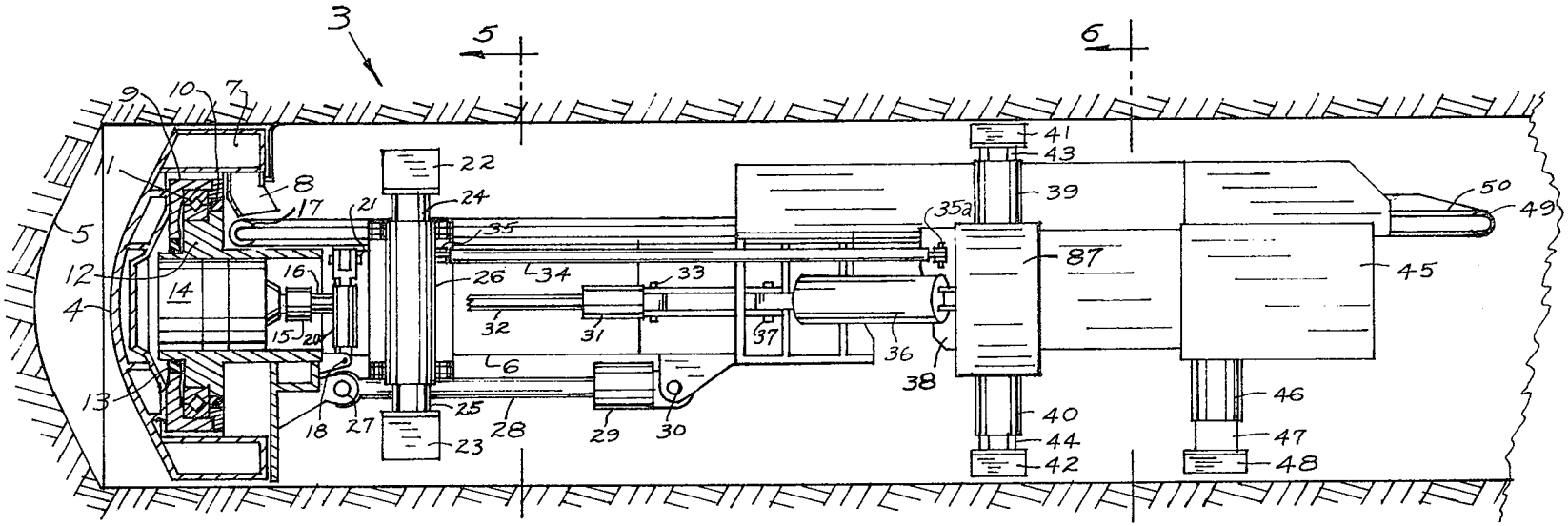
FIG. 3 is a side view in partial section of an earth boring machine constructed in accordance with the present invention.

Referring now to FIG. 3, a side view of a tunnel boring machine generally designated by the reference number 3 is shown. The tunnel boring machine 3 consists essentially of four main assemblies: a main beam assembly 6, a gripper assembly 38, a cutterhead support assembly 14 and a cutterhead assembly 4. The purpose of the rotating cutterhead assembly 4 is to cut through a subterranean earth formation to form a tunnel therein. The cutterhead support assembly 14 supports the cutterhead assembly 4 for rotation during the earth boring operation. The gripper assembly 38 provides a reaction base for propelling the main beam assembly 6, the cutterhead support assembly 14, and the cutterhead assembly 4 through the tunnel. In addition, the gripper assembly 38 in combination with a forward gripper assembly 26 restrains and controls the main beam assembly 6 relative to the tunnel walls and provides a reaction base under conditions wherein the normal side walls are absent. The main beam assembly 6 ties the cutterhead support assembly 14 together with the gripper assembly 38 and the forward gripper assembly 26. The main beam assembly 6 also provides support for the primary power apparatus 45 and various auxiliary equipment.

The cutterhead assembly 4 includes a cylindrical support shell at the forward end of which is a spherical head. A plurality of cutters are mounted on the spherical head at different radial distances from the axis of rotation. Mounted around the periphery of the cylindrical support shell is a plurality of buckets 7 which scoop and carry rock and mud (muck) from the invert of the tunnel to the top of the cutterhead assembly 4. At the top of the cutterhead assembly 4, the collected rock and muck drop through a hopper 8 onto a conveyor system 50. The rock and muck are carried along the main beam assembly 6 to the rear of the machine 3 for removal from the tunnel. Conveyor rollers such as rollers 17 and 49 facilitate removal of the rock and muck.

The cutterhead assembly 4 is mounted for rotation on the cutterhead support assembly 14. This mounting is accomplished through a set of bearings 11 suitably mounted between a bearing shroud 9 carried by the cutterhead assembly 4 and a flange-like portion 12 of the cutterhead support assembly 14. Suitable seals 10 and 13 are provided to protect the bearings 11 against rock and earth cuttings or any other deleterious material.

Power is transmitted from the main power unit 45 through the main beam assembly 6 to a gear box located within the cutterhead support assembly 14. The cutterhead assembly 4 is connected to the output of the gear box assembly in a manner well known in the art for transmission of power from the gear box to the cutterhead assembly 4. For example, in machines of the prior art, power is transmitted from the gear box to the cutterhead assembly by means of ring and pinion gears. For example, see U.S. Pat. No. 3,598,445 to Douglas F. Winberg, patented Aug. 10, 1971.

The cutterhead support assembly 14 is supported at the forward end of the main beam assembly 6 by a ball and socket or multi-directional pivot arrangement 15 which permits the cutterhead support assembly 14 to pivot both horizontally and vertically about the central axis of the tunneling machine 3. The multi-directional pivot arrangement 15 provides a universal connection between the main beam assembly and the cutterhead support assembly. Power may be transmitted through ball and socket multi-directional pivot arrangement 15 from a drive train 16 that extends through the main beam assembly 6.

To position the cutterhead support assembly 14 and the associated cutterhead assembly 4 in a particular attitude, the machine is provided with a vertical attitude cylinder 29 and piston 28 assembly. The cylinder 29 is connected to the main beam assembly 6 by a pivot connection 30. The piston rod 28 is connected to the cutterhead support assembly 14 by a pivot connection 27. By extension and contraction of the piston 28 and cylinder 29 assembly, the vertical attitude of the cutterhead support assembly 14 and cutterhead assembly 4 may be controlled. Since the axis of the vertical attitude piston 28 and cylinder 29 assembly lies on a vertical plane including the centerline of the tunnel, changes in vertical attitude do not affect the horizontal or side-to-side attitude of these assemblies.

A pair of piston and cylinder assemblies may be mounted on opposite sides of the tunnel centerline for controlling the horizontal attitude of the cutterhead support assembly 14 and cutterhead assembly 4. These piston and cylinder assemblies are pivotally connected at one end to a pivot connection attached to the cutterhead support assembly 14 and at the opposite end to a pivot connection attached to the main beam assembly 6. As shown in FIG. 3, the piston 32 and cylinder 31 assembly is connected to a pivot 33 attached to the main beam assembly 6. The piston rod 32 is shown broken away. However, it is to be understood that the end of the piston rod 32 is connected to the cutterhead support assembly 14 by a pivot connection. Cooperating extension and contraction of the horizontal attitude piston and cylinder assemblies control the horizontal attitude of the cutterhead support assembly 14 and the cutterhead assembly 4. Since the axis of the horizontal attitude piston and cylinder assemblies lie in a horizontal plane including the centerline of the tunnel, any changes in horizontal attitude do not affect the vertical attitude. The ball and socket arrangement 15 in connection with the vertical and horizontal attitude piston and cylinder assemblies permit extremely accurate attitude control for steering the machine in a desired direction.

In addition to the vertical and horizontal attitude control systems previously discussed, a pair of torque reaction piston and cylinder assemblies may be mounted on opposite sides of the tunnel centerline. One end of the torque reaction piston and cylinder assembly is pivotally connected by a pivot connection to the cutterhead support assembly 14 and the opposite end is connected by a pivot connection to the main beam assembly 6. As shown in FIG. 3, piston and cylinder assembly 20 is connected to the main beam assembly 6 by a pivot connection 21 and is connected to the cutterhead support assembly 14 by a pivot connection 18. As their name implies, the torque reaction piston and cylinder assemblies provide reaction for the torque developed by rotation of the cutterhead assembly 4, transferring such torque to the main beam assembly 6 where it is absorbed by the gripper assembly 38 and other support components. The torque reaction piston and cylinder assemblies are mounted independently of the vertical and horizontal attitude controls providing a force couple about a line passing through the articulation point of the multi-directional pivot arrangement 15. Extension or contraction of the torque reaction piston and cylinder assemblies has no effect on the vertical or horizontal attitude of the machine.

To cut a tunnel through a subterranean formation, there must of course be a means of advancing the cutterhead support assembly 14 and cutterhead assembly 4 through the formations. It is this function which is provided by the gripper assembly 38. The gripper assembly 38 is slide-mounted on the main beam assembly 6. Thus, a fore-aft sliding relationship is established between the gripper assembly 38 and the main beam assembly 6. The gripper assembly 38 includes a pair of horizontal piston and cylinder assemblies for moving gripper shoes in contact with the side walls of the tunnel. One of the horizontal gripper shoes 87 is shown in FIG. 3. When the horizontal piston and cylinder assemblies are extended, the gripper shoes contact the side walls of the tunnel and provide a base for thrusting the main beam assembly 6 and consequently the cutterhead support assembly 14 and cutterhead assembly 4 against the working face 5 of the tunnel.

The gripper assembly 38 when firmly gripping the side walls of the tunnel provides reactions for longitudinal forces necessary to advance the cutterhead support assembly 14 and cutterhead assembly 4 against the working face 5 of the tunnel. This forward motion is accomplished through a pair of hydraulic propelling rams comprising piston and cylinder assemblies on opposite sides of the main beam assembly 6. These propelling rams are pivotably connected at one end to a respective horizontal gripper shoe, piston and cylinder assembly of gripper assembly 38 and at the other end to main beam assembly 6. With the horizontal gripper shoes firmly gripping the side walls of the tunnel, the propelling rams may be extended from an initial retracted position simultaneously with the rotation of the cutterhead assembly 4, causing the main beam assembly 6, cutterhead support assembly 14 and the cutterhead assembly 4 to be advanced through the formations. This is made possible by the sliding connection between the gripper assembly 38 and the main beam assembly 6. When the propelling rams are fully extended, the gripper shoes may be retracted from the tunnel walls and the propelling rams may be contracted, causing the gripper assembly 38 to be advanced to a fore position on the main beam assembly 6 where the horizontal shoes may once again be extended to firmly grip the side walls of the tunnel for repeating the cycle.

As shown in FIG. 3, one of the propelling rams is shown, comprising a piston and cylinder assembly 36. One end of the piston and cylinder assembly 36 is connected to the main beam assembly 6 by a pivot connection 37 and to the horizontal piston and cylinder assembly of gripper assembly 38 by a pivot connection.

In addition to providing a sliding connection for the gripper assembly 38 and support for the drive train, the main beam assembly 6 serves additional purposes. It supports the conveyor assembly 50 and an operator's cab from which the tunneling machine is operated and controlled. The various hydraulic piston components and electrical controls necessary for operation of the main power unit 45 and hydraulic systems are carried in suitable compartments along with the operator's cab.

Under certain conditions, the tunnel will lack either one or both of the side walls. The horizontal piston and cylinder assemblies will be unable to extend the horizontal gripping shoes into contact with the side wall; therefore, the gripper assembly 38 would not function to establish a base for thrusting the cutterhead assembly 4 against cutting face 5. If the tunnel does not have a full side wall on both sides of the machine, the cutterhead support assembly 14 will have a tendency to shift from the desired tunnel direction. The absence of firm ground normally used to guide the cutterhead support assembly 14 and to provide reaction for the side steering cylinders makes guidance of the tunneling machine impossible. An example of a tunnel without a full side wall is when the tunnel being bored intersects an existing tunnel, losing its side wall at the intersection. Another example is when a branch drift is bored from a main drift and the machine is subsequently backed out of the branch drift to further advance the heading of the original main drift. Other conditions exist wherein normal full side walls are absent. For example, if the machine is being used for mining ore or coal, it may be operating under conditions wherein full side walls are absent.

Under circumstances wherein the horizontal gripper shoe, piston and cylinder assemblies cannot be used to allow the gripper assembly 38 to form a reaction base, a forward vertical gripper assembly 26 and gripper assembly 38 are used to form a reaction base to allow the cutterhead assembly 4 to be thrust against the working face 5 and to guide the tunneling machine 3. The forward vertical gripper assembly 26 includes a pair of gripper shoes 22 and 23 adapted to be extended into engagement with the back and invert of the tunnel, respectively. The gripper shoes 22 and 23 are connected to piston rods 24 and 25 extending from associated cylinder assemblies within the main body of forward vertical gripper assembly 26. The main beam assembly 6 slides through the forward gripper assembly 26 as the cutterhead support assembly 14 and cutterhead assembly 4 are thrust forward. The gripper assembly 38 includes a piston 43 and cylinder 39 assembly for extending a gripper shoe 41 into contact with the back of the tunnel. The gripper assembly 38 also includes a piston 44 and cylinder 40 assembly for moving a gripper shoe 42 into contact with the invert of the tunnel. The forward gripper assembly 26 and gripper assembly 38 are connected by a pair of struts on opposite sides of main beam assembly 6. As shown in FIG. 3, strut 34 is connected to the forward vertical gripper assembly 26 by a pin connection 35 and to the aft gripper assembly 38 by a pin connection 35a. A piston 47 and cylinder 46 assembly is also provided, extending from the eqiupment housing 45 to allow a gripper shoe 48 to be moved into contact with the invert of the tunnel. The piston 47 and cylinder 46 assembly provides additional support for the tunneling machine.

Figure 4:
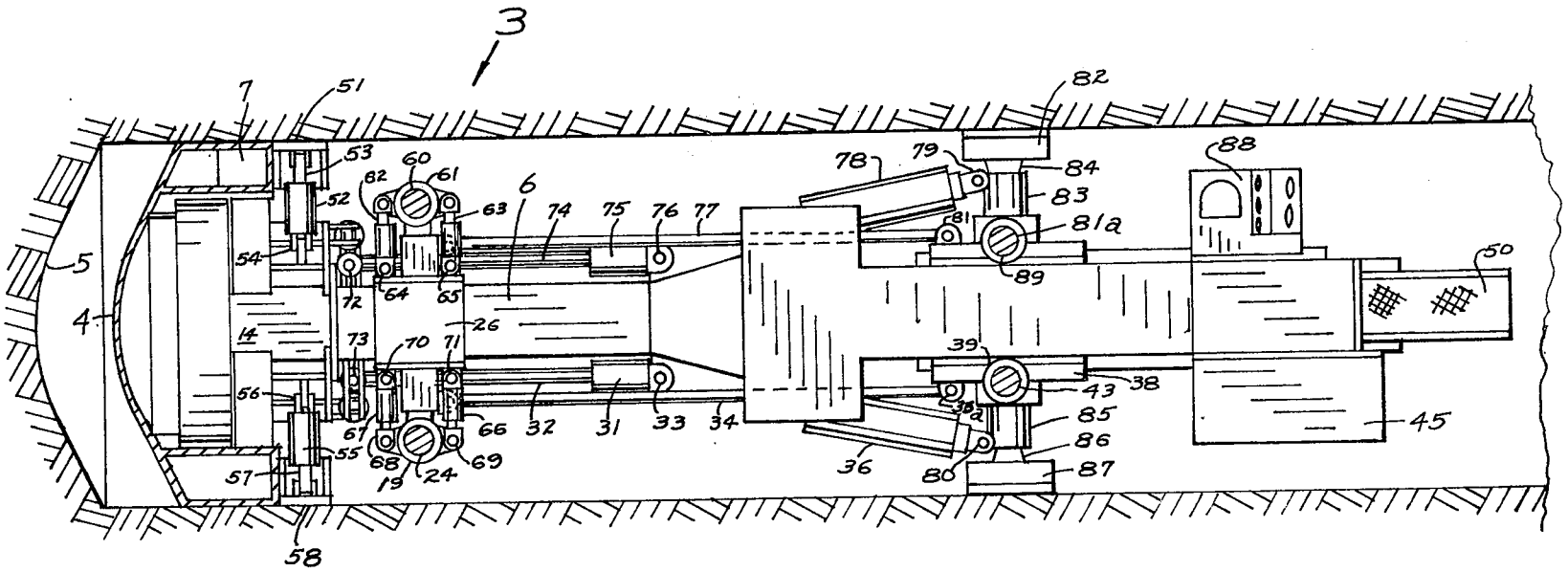
FIG. 4 is a plan view of the earth boring machine shown in FIG. 3.

Referring now to FIG. 4, a plan view of the tunnel boring machine 3 is shown. As previously discussed with reference to FIG. 3, the tunnel boring machine 3 consists essentially of four main assemblies, a main beam assembly 6, a gripper assembly 38, a cutterhead support assembly 14, and a cutterhead assembly 4. The gripper assembly 38 provides a reaction base for propelling the main beam assembly 6, the cutterhead support assembly 14, and the cutterhead assembly 4 through the tunnel. In addition, the gripper assembly 38 in combination with the forward gripper assembly 26 restrains and controls the main beam assembly 6 relative to the tunnel walls. The main beam assembly 6 ties the cutterhead support assembly 14 together with the gripper assembly 38 and the forward gripper assembly 26. The main beam assembly 6 also provides support for the primary power apparatus 45, control housing 88, and various auxiliary equipment.

The cutterhead assembly 4 includes a cylindrical support shell at the forward end of which is a spherical head. A plurality of cutters are mounted on the spherical head at different radial distances from the axis of rotation. Mounted around the periphery of the cylindrical support shell is a plurality of buckets 7 which scoop and carry the rock and muck from the invert of the tunnel to the top of the cutterhead assembly 4. The muck is carried along the main beam assembly 6 to the rear of the machine 3 by a conveyor 50.

The cutterhead assembly 4 is mounted for rotation on the cutterhead support assembly 14. Power is transmitted from the main power unit 45 through the main beam assembly 6 to the cutterhead support assembly 14. The cutterhead assembly 4 is connected to the output of a gear box in the cutterhead support assembly 14 in a manner well known in the art. For example, in machines of the prior art, power is transmitted from the gear box to the cutterhead assembly by means of ring and pinion gears. For example, see U.S. Pat. No. 3,598,445 to Douglas F. Winberg, patented Aug. 10, 1971.

A pair of side steeriing shoes 51 and 58 are mounted on opposite sides of the cutterhead support assembly 14 for guiding the cutterhead support assembly 14 and the cutterhead assembly 4. These side steering shoes 51 and 58 are connected to the cutterhead support assembly 14 by side steering piston and cylinder assemblies 52 and 55. As shown in FIG. 4, the piston rod 53 of piston and cylinder assembly 52 is connected to side steering shoe 51. The body of the piston and cylinder assembly 52 is connected to the cutterhead support assembly 14 by a pin connection 54. The piston rod 57 of piston and cylinder assembly 55 is connected to side steering shoe 58. The body of the piston and cylinder assembly 55 is connected to the cutterhead support assembly 14 by a pin connection 56. Cooperating extension and contraction of piston and cylinder assemblies 52 and 55 assists in guiding the tunneling machine 3 during the earth boring operation. It will be appreciated that if the side walls of the tunnel are absent, the side steering shoes will not operate to assist in guiding the tunnel boring machine 3.

The horizontal attitude piston and cylinder assemblies mounted on opposite sides of the main beam 6 provide control of the horizontal attitude of the cutterhead support assembly 14 and cutterhead assembly 4. As shown in FIG. 4, piston rod 74 and cylinder 75 are mounted on one side of the main beam 6, and piston rod 32 and cylinder 31 are mounted on the other side of the main beam 6. The end of piston rod 74 is connected to the cutterhead support assembly 14 by a pin connection 72. The body of the cylinder 75 is connected to the main beam assembly 6 by a pin connection 76. The end of piston rod 32 is connected to the cutterhead support assembly 14 by a pin connection 73. The body of cylinder 31 is connected to main beam assembly 6 by a pin connection 33. Cooperating extension and contraction of the horizontal attitude piston and cylinder assemblies controls the horizontal attitude of the cutterhead support assembly 14 and the cutterhead assembly 4. Since the axis of the horizontal attitude piston and cylinder assemblies lie in the horizontal plane including the centerline of the tunnel, any changes in horizontal attitude do not affect the vertical attitude.

The gripper assembly 38 provides a reaction base for advancing the cutterhead support assembly 14 and cutterhead assembly 4 through the formations. Gripper assembly 38 is slide-mounted on main beam assembly 6. Thus, a fore-aft sliding relationship is established between gripper assembly 38 and the main beam assembly 6. Gripper assembly 38 includes a pair of horizontal hydraulic cylinders 83 and 85 for moving horizontal gripper shoes 82 and 87 into contact with the side walls of the tunnel. When piston rod 84 of hydraulic cylinder 83 is extended, the horizontal gripper shoe 82 contacts the side wall of the tunnel. When piston rod 86 of hydraulic cylinder 85 is extended, the horizontal gripper shoe 87 contacts the side wall of the tunnel. This provides a reaction base for thrusting the main beam assembly 6 and consequently the cutterhead support assembly 14 and cutterhead assembly 4 against the working face 5 of the tunnel. It will be appreciated that if the side walls of the tunnel are absent, the side steering shoes will not operate to assist in guiding the tunnel boring machine.

The gripper assembly 38 when firmly gripping the side walls of the tunnel provides reactions for longitudinal forces necessary to advance the cutterhead support assembly 14 and cutterhead assembly 4 against the working face 5 of the tunnel. This forward motion is accomplished through the pair of hydraulic propelling rams comprising piston and cylinder assemblies 36 and 78 positioned on opposite sides of the main beam assembly 6. These propelling rams are pivotably connected at one end to the main beam assembly 6 and at the other end to a respective horizontal gripper shoe, piston and cylinder assembly of gripper assembly 38. The piston rod of thrust ram 36 is connected to the body of horizontal hydraulic cylinder 85 by a pin connection 80. The piston rod of thrust ram 78 is connected to the body of horizontal hydraulic cylinder 83 by a pin connection 79. With the horizontal gripper shoes 82 and 87 firmly gripping the side walls of the tunnel, the propelling rams 36 and 78 are extended from an initial retracted position simultaneously with the rotation of the cutterhead assembly 4, causing the main beam assembly 6, cutterhead support assembly 14 and the cutterhead assembly 4 to be advanced through the formations. This is made possible by the sliding connection between the gripper assembly 38 and the main beam assembly 6. When the propelling rams 36 and 78 are fully extended, the gripper shoes 82 and 87 may be retracted from the tunnel wall and the propelling rams 36 and 78 retracted. This causes the gripper assembly 38 to be advanced to a fore position on the main beam assembly 6, where the horizontal gripper shoes 82 and 87 are once again extended to firmly grip the side walls of the tunnel for repeating the cycle. Under certain conditions, the tunnel will lack either one or both side walls. The horizontal piston and cylinder assemblies will be unable to extend the horizontal gripping shoes 82 and 87 into contact with side walls; therefore, the gripper assembly 38 would not function to establish a base for thrusting the cutterhead assembly 4 against the cutting face. If the tunnel does not have a full side wall on both sides of the machine, the cutterhead support assembly 14 will have a tendency to shift from the desired tunnel direction. The absence of firm ground, normally used to guide the cutterhead support assembly 14 and to provide reaction for the side steering shoes 51 and 58 and cylinders 52 and 55, makes guidance of the tunneling machine impossible. An example of a tunnel without a full side wall is when the tunnel being bored intersects an existing tunnel, losing its side wall at the intersection. Another example is when a branch drift is bored from a main drift and the machine is subsequently backed out of the branch drift to further advance the heading of the original main drift. Other conditions exist wherein normal full side walls are absent. For example, if the machine is being used for mining ore or coal, it may be operating under conditions wherein full side walls are absent.

Under circumstances wherein either one or both side walls are absent and the horizontal gripper shoes 82 and 87 cannot be used to allow the gripper assembly 38 to form a reaction base, a forward vertical gripper assembly 26 and gripper assembly 38 is used to form a reaction base to allow the cutterhead assembly 4 to be thrust against the working face 5 and to guide the tunneling machine 3. The forward vertical gripper assembly 26 comprises two upper gripper shoes connected to piston rods 24 and 60 for contacting the back of the tunnel and two lower gripper shoes adapted to contact the invert of the tunnel. The upper gripper shoes connected to piston rods 24 and 60 are extended by actuation of the hydraulic cylinders 19 and 61. In a similar fashion, the lower gripper shoes are extended into contact with the invert of the tunnel by actuation of hydraulic cylinders. The main beam assembly 6 slides through the forward gripper assembly 26 as the cutterhead support assembly 14 and cutterhead assembly 4 are thrust forward.

Horizontal guiding hydraulic cylinder assemblies 62, 63, 66 and 67 are connected between the body of forward gripper assembly 26 and the vertical hydraulic cylinders 61 and 19. The body of forward gripper assembly 26 is in turn in sliding contact with main beam assembly 6. The cylinder assembly 62 has one end connected to vertical cylinder 61 and the other end connected to the body of forward gripper assembly 26 by a pin connection 64. The cylinder assembly 63 has one end connected to the vertical cylinder 61 and the other end connected to the body of forward gripper assembly 26 by a pin connection 65. The cylinder assembly 66 has one end connected to vertical hydraulic cylinder 19 by a pin connection 69 and the other end connected to the body of forward gripper assembly 26 by a pin connection 71. The hydraulic cylinder assembly 67 has one end connected to the vertical cylinder 19 by a pin connection 68 and the other end connected to the body of forward gripper assembly 26 by a pin connection 70. Cooperating extension and retraction of horizontal guiding cylinder assemblies 62, 63, 66 and 67 provides a guiding force to the main beam assembly 6 during boring operations wherein the tunnel does not have a full side wall.

The forward gripper assembly 26 is connected to the gripper assembly 38 by a pair of struts 34 and 77 on opposite sides of the main beam assembly 6. Under conditions wherein either one or both side walls are absent and the horizontal gripper shoes 82 and 87 cannot be used to allow the gripper assembly 38 to form a reaction base, a pair of upper gripper shoes are extended to contact the back of the tunnel, and a pair of lower gripper shoes are extended to contact the invert of the tunnel. The upper gripper shoes are connected to piston rods 81a and 43 of hydraulic cylinders 89 and 39, respectively. In a similar fashion, the lower gripper shoes are connected to the piston rods of lower vertical hydraulic cylinders. With the upper and lower gripper shoes firmly engaged with the back and invert of the tunnel, the gripper assembly 38 provides reaction for longitudinal forces necessary to advance the cutterhead support assembly 14 and cutterhead assembly 4 against the working face 5 of the tunnel. This action is accomplished through the hydraulic rams comprising piston and cylinder assemblies 78 and 36 positioned on opposite sides of the main beam assembly 6. The propelling rams 78 and 36 are extended from an initial retracted position simultaneously with the rotation of the cutterhead assembly 4, causing the main beam assembly 6, cutterhead support assembly 14, and the cutterhead assembly 4 to be advanced through the formations. This is made possible by the sliding connection between the gripper assembly 38 and the main beam assembly 6. When the propelling rams 36 and 78 are fully extended, the upper and lower gripper shoes are retracted from the back and invert of the tunnel, and the propelling rams 36 and 78 are retracted. This causes the gripper assembly 38 to be advanced to a fore position on the main beam assembly 6, wherein the upper and lower gripper shoes are once again extended to firmly grip the back and invert of the tunnel for repeating the cycle.

Figure 5:
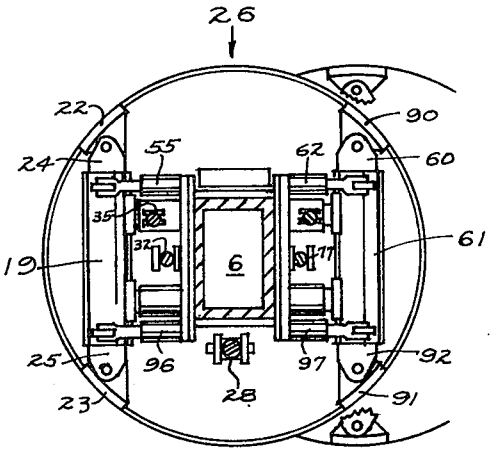
FIG. 5 is a sectional view of the earth boring machine taken along lines 5—5 of FIG. 3.

Referring now to FIG. 5, a sectional view of the earth boring machine 3, taken along the lines 5—5 of FIG. 3, is shown. Under conditions wherein the tunnel does not have a full side wall on both sides of the machine, the cutterhead support assembly 14 will have a tendency to shift from the desired tunnel direction. The forward vertical gripper assembly 26 provides assistance in guiding the tunneling machine under such conditions. Forward vertical gripper assembly 26 includes upper gripper shoes 22 and 90, adapted to be extended into engagement with the back of the tunnel. The upper gripper shoes 22 and 90 are connected to piston rods 24 and 60, respectively, extending from associated cylinder assemblies 19 and 61. The forward vertical gripper assembly 26 also includes a pair of lower gripper shoes 23 and 91, adapted to be extended into engagement with the invert of the tunnel. The gripper shoes 23 and 91 are connected to piston rods 25 and 92, respectively, extending from associated cylinder assemblies 19 and 61. The main beam assembly 6 slides through the forward gripper assembly 26 as the cutterhead support assembly 14 and cutterhead assembly 4 are thrust forward. Horizontal guiding hydraulic cylinders 55 and 96 are connected between the body of forward gripper assembly 26 and vertical hydraulic cylinder 19. The body of the forward gripper assembly 26 is, in turn, in sliding contact with the main beam assembly 6. Horizontal guiding hydraulic cylinders 62 and 97 are connected between the body of the forward gripper assembly 26 and vertical hydraulic cylinder 61. The body of the forward gripper assembly 26 is, in turn, in sliding contact with the main beam assembly 6. Cooperating extension and retraction of horizontal guiding cylinders 55, 96, 62 and 97 provide a guiding force to the main beam assembly 6 during boring operations wherein the tunnel does not have a full side wall.

Figure 6:
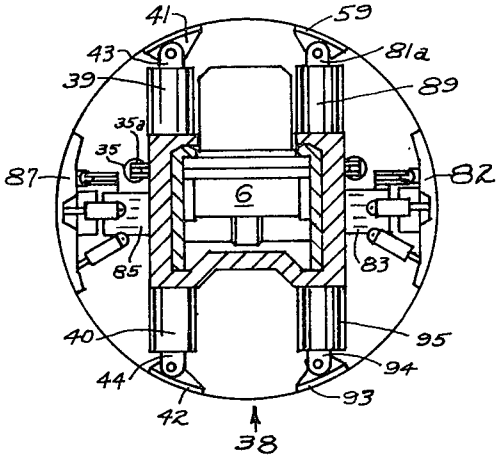
FIG. 6 is a sectional view of the earth boring machine taken along lines 6—6 of FIG. 3.

Referring now to FIG. 6, a sectional view of the earth boring machine 3 taken along lines 6—6 of FIG. 3 is shown. Under certain conditions the tunnel will lack either one or both side walls. The horizontal piston and cylinder assembly will be unable to extend the horizontal gripping shoes 82 and 87 into contact with the side walls. Under such circumstances, the two upper gripper shoes 41 and 59 are extended into contact with the back of the tunnel and the two lower gripper shoes 42 and 93 are extended into contact with the invert of the tunnel. The piston rods 43 and 81a of hydraulic cylinders 39 and 89, respectively, serve to extend and retract upper gripper shoes 41 and 59. The piston rods 44 and 94 of hydraulic cylinders 40 and 95, respectively, serve to extend and retract lower gripper shoes 42 and 93. The gripper assembly 38 when firmly gripping the back and invert of the tunnal with gripper shoes 41, 59, 42 and 93 provides reaction for longitudinal forces necessary to advance the cutterhead support assembly 14 and cutterhead assembly 4 against the working face 5 of the tunnel. The propelling rams are extended from an initial retracted position simultaneously with the rotation of the cutterhead assembly 4, causing the main beam assembly 6, cutterhead support assembly 14 and cutterhead assembly 4 to be advanced through the formations. When the propelling rams are fully extended, the gripper shoes 41, 59, 42 and 93 may be retracted from the back and invert of the tunnel and the propelling rams retracted. This causes gripper assembly 38 to be advanced to a fore position on the main beam assembly 6 where the gripper shoes 41, 59, 42 and 93 are once again extended to firmly grip the back and invert of the tunnel for repeating the cycle. In addition, these four gripper shoes can be extended and retracted in cooperation to shift the aft end of the main beam 6 up or down to aid in providing steering of the tunneling machine 3 in the vertical plane.

The structural details of an earth boring machine constructed in accordance with the present invention having been described, the operation of the earth boring machine 3 will now be considered with reference to FIGS. 1–6. The earth boring machine 3 is advanced forward allowing the cutters on the cutterhead assembly 4 to disintegrate the formations at the face 5 of the tunnel. The horizontal gripper shoes 82 and 87 are firmly engaged with the side walls of the tunnel and the propelling rams 36 and 78 are extended causing the main beam assembly 6 to be thrust forward, thrusting the cutterhead support assembly 14 and the cutterhead assembly 4 against the face 5 of the tunnel. Rotation of the cutterhead assembly 4 by power transmitted from housing 45 through drive train 16 to the cutterhead support assembly 14 and to cutterhead assembly 4 causes the cutterhead to disintegrate the formations at the working face 5 of the tunnel.

Under circumstances wherein the tunnel does not have one or both full side walls, the cutterhead support assembly 14 will have a tendency to shift from the desired tunnel direction and the gripper shoes 82 and 87 will be unable to form a reaction base for thrusting the main beam assembly 6 forward. The forward gripper assembly 26 and the gripper shoes 41, 59, 42 and 93 of gripper assembly 38 are used to guide the tunneling machine 3 and provide a reaction base for thrusting main beam assembly 6 forward. The gripper shoes 22, 90, 23, and 91 of forward vertical gripper assembly 26 are engaged with the back and invert of the tunnel, respectively. The horizontal cylinders 55, 62, 96 and 97 provide a horizontal force to guide tunneling machine 3. Since the side steering shoes 51 and 58 are unable to contact the side walls of the tunnel, the aforementioned guiding force provided by vertical gripper assembly 26 is important in allowing the tunneling machine to operate under conditions wherein one or both side walls are absent.

The forward vertical gripper assembly 26 is connected to gripper assembly 38 by struts 34 and 77. The gripper assembly 38 provides a reaction base for thrusting main beam assembly 6 forward when the gripper shoes 41, 59, 42 and 93 of gripper assembly 38 are extended into contact with the back and invert, respectively, of the tunnel. The propelling rams 36 and 78 are extended from an initial retracted position simultaneously with the rotation of the cutterhead assembly 4 causing the main beam assembly 6, cutterhead support assembly 14 and cutterhead assembly 4 to be advanced forward through the formations. Cooperative extension and retraction of gripper shoes 41, 59, 42 and 93 provide steering of the tunneling machine 3 in a vertical plane by shifting the aft end of the main beam assembly 6 up or down thereby changing the course of cutterhead assembly 4 through the formations.

The embodiments of the invention in which an exclusive property or privilege is claimed are defined as follows:

1. In an earth boring machine for forming an excavation by disintegrating earth formations, said earth boring machine including main beam means, primary gripper means for contacting the sidewalls of the excavation, cutterhead means connected to said main beam means for disintegrating earth formations, and power means coupled to said cutterhead means for providing power to said cutterhead means, said excavation normally having sidewalls, a back and an invert, but occasionally lacking one or both of the sidewalls, the improvement comprising:

secondary gripper means in sliding contact with said main beam means for establishing a reaction base to allow the cutterhead means to be forced into contact with the earth formations under conditions where said excavation lacks one or both of the sidewalls, said secondary gripper means including a first gripper unit for engaging the invert and back of the excavation, a second gripper unit for engaging the invert and back of the excavation, and thrust means operably connected between said second gripper unit of said secondary gripper means and said cutterhead means for forcing said cutterhead means into contact with said earth formations, said thrust means also operably connected between said primary gripper means and said cutterhead means for forcing said cutterhead means into contact with said earth formations.

2. In an earth boring machine for forming an excavation by disintegrating earth formations, said earth boring machine including main beam means, primary gripper means for contacting the sidwalls of the excavation, cutterhead means connected to said main beam means for disintegrating earth formations, power means coupled to said cutterhead means for providing power to said cutterhead means for disintegrating earth formations, and thrust means operably connected between said primary gripper means and said cutterhead means for forcing said cutterhead means into contact with said earth formations, the improvement comprising:

first auxiliary gripper means in sliding contact with said main beam for engaging the invert and back of the excavation, said first gripper means including guiding thrust means between said first auxiliary gripper means and said main beam for providing a guiding thrust force; and second auxiliary gripper means in sliding contact with said main beam for engaging the invert and back of the excavation, said second auxiliary gripper means connected to said thrust means.

3. In an earth boring machine for forming an excavation by disintegrating earth formations, including main beam means for longitudinal disposition within said excavation thereby establishing a longitudinal axis, rotary cutterhead means connected to said main beam for disintegrating earth formations to form the excavation, side steering means and main gripper means for extension generally horizontally relative to said longitudinal axis and contacting the sidewalls of the excavation to form a reaction base for operating the machine under normal conditions wherein the excavation has both sidewalls, thrust means connected to said main gripper means and operably connected to said rotary cutterhead means for forcing said rotary cutterhead means into contact with said earth formations, and power means coupled to said cutterhead means for providing power to said cutterhead means, the improvement for operation under conditions wherein at least one sidewall is absent, comprising:

supplemental gripper means in sliding contact with said main beam means for establishing a reaction base to allow the cutterhead means to be forced into contact with the earth formations and properly guided, said supplemental gripper means including:

a first vertical gripper unit connected to said main gripper means for engaging the invert and back of the excavation, a second vertical gripper unit spaced along said main beam means from said first vertical gripper unit for engaging the invert and back of the excavation, and guiding thrust means in sliding contact between said second gripper unit and said main beam means for providing a guiding thrust force.

4. An earth boring machine for forming an excavation through earth formations by disintegrating a portion of the earth formations, said excavation including walls at some locations and lacking at least one wall at other locations, said excavation including a back and an invert, comprising:

main beam means;

cutterhead support means connected to said main beam means; side steering shoes connected to said cutterhead support means for selectively contacting the walls of the excavation and providing a side steering force;

a cutterhead connected to said cutterhead support means for disintegrating earth formations;

power means coupled to said cutterhead for providing power to said cutterhead;

main gripper means slidably connected to said main beam means for establishing a reaction base to allow the cutterhead to be forced into contact with the earth formations, said main gripper means including a first gripper unit substantially horizontal to said main beam means for selectively gripping the walls of the excavation and a second gripper unit positioned substantially vertical to said main beam means for selectively gripping the back and invert of the excavation;

a forward gripper assembly slidably connected to said main beam means for establishing a reaction base, said forward gripper assembly including a forward vertical gripper means for selectively gripping the back and invert of the excavation;

guiding thrust means slidably connected between said forward vertical gripper means and said main beam for providing a guiding thrust force; and thrust means operably connected between said main gripper means and said cutterhead support means for forcing said cutterhead into contact with said earth formations.

5. A machine for boring a tunnel in a subterranean formation, comprising:

a main beam assembly for longitudinal disposition within said tunnel, said main beam assembly establishing a longitudinal axis;

a cutterhead support assembly connected to said main beam;

a cutterhead assembly including a cutterhead mounted on said cutterhead support assembly for rotation generally about said longitudinal axis;

power means coupled to said cutterhead assembly for rotation of said cutterhead;

main gripper means acting generally horizontal to said longitudinal axis for facilitating the advance of said main beam, cutterhead support, cutterhead assembly, and cutterhead longitudinally through said tunnel;

a first vertical gripper assembly positioned around said main beam assembly slidably connected to said main beam assembly and engageable with the back and the invert of said tunnel for facilitating the advance and guidance of said main beam, cutterhead support, cutterhead assembly, and cutterhead through said tunnel;

guiding thrust means between said first vertical gripper assembly and said main beam assembly for providing a horizontal force to said main beam assembly;

a second vertical gripper assembly positioned around said main beam assembly slidably connected to said main beam assembly and engageable with the back and invert of said tunnel for facilitating the advance of said main beam, cutterhead support, cutterhead assembly, and cutterhead longitudinally through said tunnel; and thrust means for forcing said cutterhead against said subterranean formation.

6. In an earth boring machine for forming an excavation usually having sidewalls and always having a back and an invert, by disintegrating earth formations, including main beam means, cutterhead means connected to said main beam means for disintegrating earth formations, power means coupled to said cutterhead means for providing power to said cutterhead means for disintegrating earth formations, main gripper means for engaging the sidewalls of the excavations, and thrust means for forcing said cutterhead means into contact with said earth formations, the improvement comprising:

a first gripper unit in sliding contact with said main beam, said first gripper unit having at least one first gripper shoe and first means for extending said at least one first gripper shoe generally vertically into engagement with the back and invert of said excavation when the sidewalls are absent; and a second gripper unit in sliding contact with said main beam, said second gripper unit having at least one second gripper shoe and second means for extending said at least one second gripper shoe generally vertically into engagement with the back and invert of the excavation when the sidewalls are absent.

* * * * *